US006499314B1

(12) United States Patent
Weinmann et al.

(10) Patent No.: US 6,499,314 B1
(45) Date of Patent: Dec. 31, 2002

(54) DECORATED PEARL WITH INTEGRATED ORNAMENTAL ELEMENT

(75) Inventors: Gabriele Weinmann; Wigbert Stapff, both of Heidelberg (DE)

(73) Assignee: Weinmann + Stapff, Heidelberg (DE)

( * ) Notice: Subject to any disclaimer, the term of this patent is extended or adjusted under 35 U.S.C. 154(b) by 0 days.

(21) Appl. No.: 09/786,127

(22) PCT Filed: Sep. 3, 1999

(86) PCT No.: PCT/EP99/06507

§ 371 (c)(1),
(2), (4) Date: Mar. 1, 2001

(87) PCT Pub. No.: WO00/13540

PCT Pub. Date: Mar. 16, 2000

(30) Foreign Application Priority Data

Sep. 3, 1998 (DE) ..... 198 40 116

(51) Int. Cl.[7] ..... A44C 17/02
(52) U.S. Cl. ..... 63/26; 63/32; 63/33
(58) Field of Search ..... 63/23, 26, 32, 63/33, 38

(56) References Cited

U.S. PATENT DOCUMENTS

| | | | | |
|---|---|---|---|---|
| 2,261,958 A | | 11/1941 | Burri | 63/32 |
| 3,835,665 A | * | 9/1974 | Kitchel | 63/32 |
| 4,081,972 A | * | 4/1978 | Kottlar | 63/31 |
| 4,292,715 A | * | 10/1981 | Huddon | 63/13 X |
| 6,381,985 B1 | * | 5/2002 | Burgard | 63/29.1 |

FOREIGN PATENT DOCUMENTS

| | | | | |
|---|---|---|---|---|
| AT | 95954 | * | 9/1923 | 63/32 |
| BE | 716388 | | 11/1968 | |
| CH | 611 142 A2 | * | 5/1979 | 63/33 |
| DE | 44 06 609 | | 9/1995 | |
| FR | 692877 | | 11/1930 | |
| FR | 2299830 | | 9/1976 | |
| FR | 2680954 | | 3/1993 | |
| GB | 116003 | | 5/1918 | |

* cited by examiner

*Primary Examiner*—J. J. Swann
*Assistant Examiner*—Ruth C. Rodriguez
(74) *Attorney, Agent, or Firm*—Arent Fox Kintner Plotkin & Kahn, PLLC

(57) ABSTRACT

The invention relates to natural or artificial pearl in which one or more ornamental elements (4) are inserted in form of an inlay with or without a mount, wherein the outer visible top or ornamental side opposite the pearl of each inlay has a horizontal projection with a random contour and dimensions confined by the limits of the spherical surface and wherein the inner bottom side facing the pearl of each inlay is fitted with locking or anchoring means (20). Each inlay is lodged with positive-fit or at least substantially with positive-fit in an appropriately matching groove (6) (slot, cavity), locking and/or anchoring means being formed in the bottom and/or wall of said groove which interact with the corresponding inlay, preferably by positive locking according to the key-lock principle, and in or on which the inlay inserted into the groove is fixed in or on the pearl.

48 Claims, 10 Drawing Sheets

Figure 1:
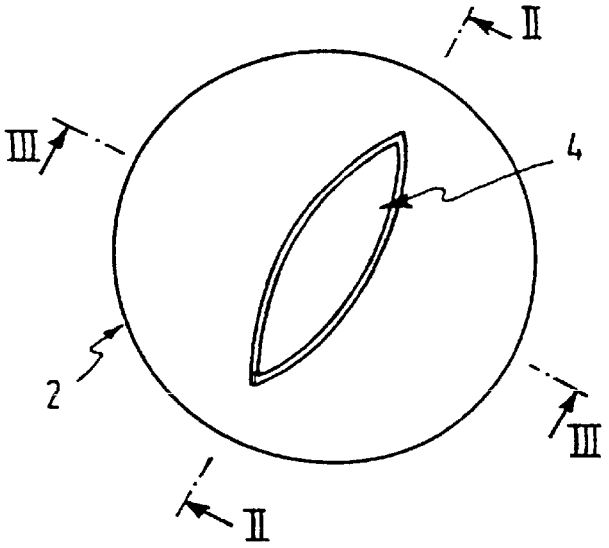

FIG.24
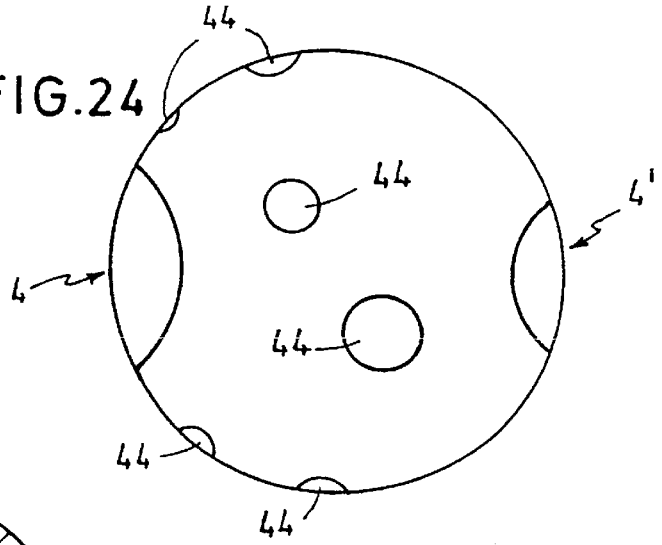
FIG.25
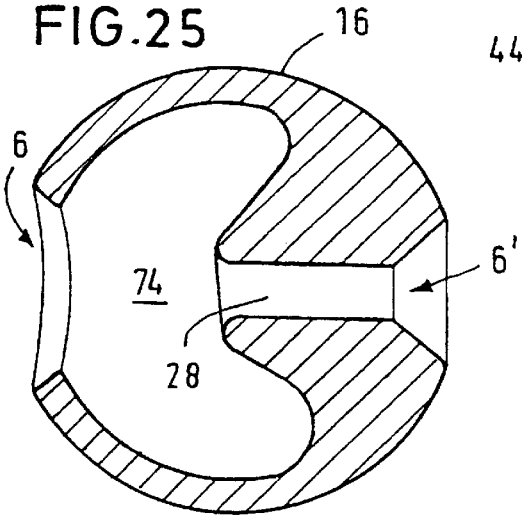
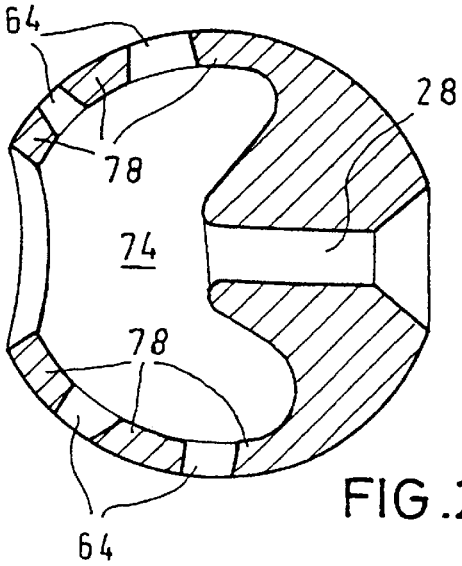
FIG.26
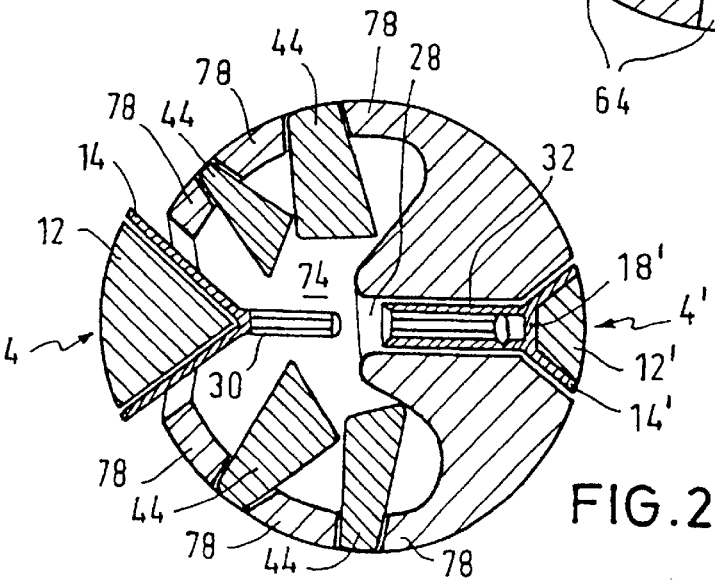
FIG.27

DECORATED PEARL WITH INTEGRATED ORNAMENTAL ELEMENT

This application is a U.S. national stage application, filed under 35 U.S.C. 371, of PCT/EP99/06507 filed on Sep. 3, 1999.

DESCRIPTION

The invention relates to a decorated natural or artificial pearl having an integrated ornamental element, and a method of manufacturing same. As ornamental elements, in particular semi-precious or precious stones are provided; parts formed from other materials, for example wood, glass, acrylic glass, inter alia, also come into consideration however.

Pearls from oysters have been from time immemorial a beloved and desired type of jewellery and since the beginning of pearl cultivation approximately 100 years ago an independent pearl market has developed which plays an important role in the jewellery industry. Amongst pearls those which have an ideal or almost ideal spherical shape and a uniformly formed spherical surface have always been preferred and consequently traded most.

In pearl cultivation and also in nature, however, it frequently happens that the pearl has a so-called "open place". This means: the seed which the cultivator has inserted into the oyster or which has reached it in the natural manner is not uniformly covered with mother-of-pearl by the oyster but at one or more places no mother-of-pearl at all or only a relatively very thin layer of same is deposited, such that more or less deep pits of the most varied shape and extent have arisen. These "imperfect" "open places" on pearls count generally as a defect and considerably lessen the quality and thus the market value of the affected pearls.

It is admittedly generally known that a natural or artificial pearl can be provided with a through-bore or a blind end bore in order to draw it up on a thread and thus manufacture for example necklaces or bracelets, or in order to place it on a pin and secure it thus for example to rings, decorative pins and other jewellery bases. These bores are however in many if not even most cases not suitable for concealing "open places", solely for the reason that the relevant "open place" has too great a diameter and/or the affected pearl has a plurality of "open places" which do not lie (by chance) on a line through the pearl centre.

The use of pearls is varied and includes also the combination of pearl(s) with precious stone(s). With such combinations it is generally a question of additions, i.e. a side-by-side arrangement of pearl(s) and stone(s), pearl(s) and stone(s) respectively representing separate, independent components of a brooch, a necklace, a bracelet, ring or some other piece of jewellery.

Up to present only one type of integrated combination of pearl and precious stone has been known. In this so-called "decorated pearl" the pearl is provided with a blind end bore running radially and a precious stone mounted in metal is cemented into this bore. The blind end bore has a round cross-section which is substantially smaller than half the diameter of the pearl and the shape of the precious stone or its mount is inevitably closely adapted thereto in terms of size and contour. DE 44 06 609 describes such a decorated natural or artificial pearl in which an ornamental element is introduced into a blind hole. The limited dimensions of the recess, here a bore, are considered as important in order not to impair the stability of the pearl.

The object underlying the invention is now to make available a decorated natural or artificial pearl having an integrated semi-precious or precious stone or ornamental elements formed from other materials or respectively a decoration for pearls, more especially for pearls with "open places" and a method of manufacturing decorated pearls of this type, the decoration taking up regions of any size of the pearl surface and the spherical surface being able to be designed in any way.

This object is achieved in the provision of a natural or artificial pearl of the type mentioned initially in which one or more ornamental elements is (are) configured as an inlay with or without a mount, the outer, visible upper or ornamental side, remote from the pearl, of each inlay having a horizontal projection of any contour and dimensions within the limits of the spherical surface, and the inner underside, facing the pearl, of each inlay being provided with at least one locking and/or anchoring means. Each inlay is accommodated as a form-fit or at least substantially as a form-fit in a recess (depression, pit) appropriately made for it, in the base and/or wall of which locking and/or anchoring means are formed which co-operate with those of the inlay, preferably by positive locking according to the key-lock principle, and in or respectively on which the inlay sitting in the recess is secured in or on the pearl.

The recess(es) can be relatively flat and lie only in the outer (peripheral) spherical layers (mother-of-pearl layers) of the pearl. It is equally possible to configure one recess, a plurality of or all the recesses in the shape of a wedge, cone or tetrahedron, the tip of the wedge, cone or tetrahedron pointing in each case to the pearl seed or pearl centre.

The term "base of the recess" comprises here and below not only more or less flat surfaces—such as are present for example in cuboid recesses—but also inner edges—e.g. in the case of wedge—or notch-shaped recesses, or also inner tips—e.g. in the case of recesses shaped like a pointed cone.

A preferred embodiment of the pearl according to the invention, which is particularly easy to manufacture, is characterized in that the locking or anchoring means is formed on the underside of the inlay- as a projection (projections), more especially as a wedge (wedges), pin (pins), lug (lugs) or feather (feathers), and in that the locking and/or anchoring means complementary thereto are realized as depressions, especially as grooves or tubular (blind) hole(s) on the base and/or in the wall of the recess in the pearl.

In a variant of the invention having at least two inlays, provision is made for the pearl surface to have at least two recesses each having respectively one tubular hole as a locking or anchoring means, which recesses are disposed spatially in relation to one another in such a manner that the at least one hole at the base of the one recess forms with the at least one hole at the base of the other recess a—preferably practically rectilinear—tubular passage between the two recesses. The inlays provided for this purpose have complementary connecting means to one another as locking and/or anchoring means, pin-shaped anchoring means which are designed as connecting means complementary to one another, preferably on the one hand as a threaded pin (solid or hollow pin with external thread) and on the other hand as the complementary threaded sleeve (hollow pin with correspondingly complementary inner thread). When the inlays concerned sit in the recesses, these connecting means are inserted in the tubular passage and are connected to one another there—in the case of threaded pin and threaded sleeve, screwed to one another. Thus particularly stable anchoring of the inlay on the pearl is guaranteed.

In a special development of this variant of the invention, the recess for the one inlay is extended like a cavity tangentially and radially below the pearl surface, and the cavity walls pointing away from the interior of the pearl are provided with window-like hole apertures, so-called window openings, in which—preferably unmounted—ornamental elements sit. These ornamental elements have the shape of a pyramid or (truncated) cone and are oriented in the window openings in such a way that the base of the pyramid or (truncated) cone points towards the interior of the pearl. By jamming and/or supporting one another and/or being supported on the cavity walls and/or the inlay sitting in the recess/the two recess(es), the position of these ornamental elements in the window openings is fixed.

A further way of accomplishing the object set consists in the provision of a pearl of the type mentioned initially in which the pearl consists of two or more spherical portions, between which respectively at least one disc-shaped ornamental element is disposed, the two disc surfaces of which are preferably congruent with the respectively adjoining (disc-shaped) basal surface of the respective spherical portion. According to the invention, there is formed in each spherical section and in each disc-shaped ornamental element a through-bore which runs perpendicular to the basal surfaces of the spherical portions and of the disc-shaped ornamental element or elements and preferably through the respective centre of same, and is flush with the through-bore(s) of the adjoining spherical portion/portions or respectively disc-shaped ornamental element/elements. In the through-bore of each spherical portion is respectively fixed a portion or section (end section or end piece or intermediate section or intermediate piece) of an outer sleeve which represents the functional counterpart to an inner sleeve, namely in such a way that inner sleeve and outer sleeve can be positioned secure against twisting in respect of one another via means which are formed between the inner sleeve outer wall and the outer sleeve inner wall. In other words the inner sleeve can only be pushed into the outer sleeve in a single orientation in respect of same. In the outer sleeve portions and the through-bores of the disc-shaped ornamental element/elements is guided the inner sleeve representing the counterpart to the outer sleeve, such that the spherical portions are disposed in an exactly pre-determined position in relation to one another and fixed there. The inner sleeve is—preferably at least at its two free ends—connected to the outer sleeve so as to be secure against axial displacement—preferably with the two end faces of the outer sleeve (portions) ending at the pearl spherical surface (of the two calorie shells).

The advantage of the natural or artificial pearl according to the invention consists in the fact that the ornamental element is integrated without a mount into the pearl or its surface, and mother-of-pearl and ornamental element material, for example precious stone, lie directly beside one another practically seamlessly—just as if this combination had grown in a natural manner.

A variant of this decorated natural or artificial pearl having apparently seamlessly integrated ornamental elements without any visible mount is characterized in that in at least one spherical portion at least one window-like hole, i.e. a so-called "window opening" is formed in which an inlay in the shape of a pyramid or cone is disposed, the horizontal projection of which corresponds to that of the window opening and the thicker pyramid or cone base end faces the pearl interior and is supported on the pearl seed located there.

Through the pyramid or cone shape of the relevant inlay and its positioning with the thicker pyramid or cone base in the pearl interior, the optical impression is created that the pearl has inclusions which continue into the interior of the pearl or even make up the whole pearl seed.

The subject matter of the present invention. is furthermore a method of manufacturing a decorated or artificial pearl which comprises the following steps:

the natural or artificial pearl is provided with an incision, a depression is introduced into the natural or artificial pearl, the depression produced being located on the base or the wall of the pearl incision, the ornamental element is fitted into the incision, the ornamental element is secured in the pearl incision, the depression serving to anchor an anchoring means which is secured to the ornamental element, the ornamental element is ground following the pearl surface or adapted in some other way known to the expert to follow the pearl surface, the surface of the ornamental element being integrated into the surface of the pearl.

By preference the natural or artificial pearl is first cut into and then the depression is applied to the base or the wall of the pearl incision. The depression can for example be introduced by boring or milling. The incision is preferably made with a cutting wheel, for example with a cutting wheel set with diamonds. If necessary, the incision can be further processed, for example with a diamond file. What is important is that the edges of the incision remain as smooth as possible. The angle of the pearl incision is preferably between 90 and 60°. The recess which is produced by the pearl incision can assume various shapes. It can be in the shape of a wedge, cone or tetrahedron, the tip of the wedge, cone or tetrahedron in each case pointing towards the pearl seed; it is also possible for these tips to point towards the pearl centre. The recess can be flat or deep. The depression produced can be for example a groove or a tubular blind hole which can be recessed further if necessary. However it is not limited to the embodiments mentioned; rather, the depression can assume any of the shapes known to the expert in order to be able to accommodate corresponding anchoring means. In a preferred embodiment the depression is a blind hole which is produced by a bore. In a particularly preferred embodiment of the method according to the invention, instead of working step c), a stone mount is fitted exactly into the pearl incision such that the anchoring means which is secured both to the stone mount and to the ornamental element is fitted into the depression or into the bore and then the ornamental element is fitted into the mount. In this variant of the method, in which the ornamental element with the mount is introduced into the pearl, in method step d) the ornamental element in the stone mount is secured in the pearl incision, the depression or the bore serving to anchor an anchoring means which is secured to the ornamental element and the stone mount. The ornamental element with or without mount can, in addition to being secured by the anchoring means, also be secured by adhesive, e.g. cement, to the pearl. The pearl incision is preferably almost completely filled by the ornamental element with or without the mount. The ornamental element is now adapted to follow the pearl surface, for example by grinding. If the ornamental element sits in a mount and the mount has not yet been adapted to the surface, the ornamental element can be ground together with the mount in one working step to follow the pearl surface. This working step requires extraordinary care since the sensitive surface of the pearl must not be damaged. In a particularly preferred embodiment of the method, one or more locking bores are applied to the stone mount and the ornamental element to accommodate a portion of the anchoring means, the locking bores in the ornamental element and in the mount matching one another exactly and another portion of the anchoring means being anchored in the depression or in the bore of the pearl incision.

Particularly preferred according to the method according to the invention is the use of an anchoring pin as the anchoring means. It is particularly advantageous if the anchoring means grips through the locking holes of the stone mount into the locking holes of the ornamental element like a clasp. The locking of the stone is effected when stone, stone mount and anchoring means are secured in the pearl. Furthermore it is advantageous if the anchoring pin when inserted also exerts pressure on the depression or on the bore of the pearl incision, which serves to anchor the stone and stone mount in the pearl incision.

Variants of the method described above are also the subject matter of the present invention. For example the ornamental element can be secured in the pearl incision by more than one anchoring means. Correspondingly, proceeding from the pearl -incision a plurality of depressions can be provided in which anchoring means are anchored. Furthermore a plurality of gemstones with or without a mount can be incorporated in one pearl. These ornamental elements can be connected to one another by securing or anchoring, or can also be secured independently of one another in the respective pearl incision or the recess. Different ornamental elements can be introduced in a sub-divided mount into a pearl incision.

The subject matter of the present invention is furthermore an anchoring pin for anchoring gemstones in pearl incisions. The pin is configured by means of a resilient mechanism as a clip, stopper or locking device in order to hold the ornamental element and/or stone mount, pressure being exerted on the anchoring depression or on the anchoring bore after the pin has been inserted with the ornamental element and/or stone mount into the pearl incision. The anchoring pin is preferably so constructed that when it is inserted into the anchoring depression it is clamped, squeezed, pressed, blocked. As a further variant it is possible for the anchoring pin to be glued or cemented in addition during this process. The pin can alternatively also be soldered securely to the mount. In the latter case the upper part of the pin does not necessarily act as a clasp which grips in the locking holes of the stone or of the mount, the stone is then held in the mount by other means. For example an additional small pin can grip through the mount into the locking bores. However other means known to the expert can also be used to hold the stone in the mount.

In particular through the construction of the pin it is guaranteed that the anchoring of the ornamental element is locally separated from the actual pearl incision. This means, even if the pearl incision itself is relatively flat, the anchoring portion of the pin preferably extends into the vicinity of the seed or by particular preference into the seed of the pearl. With incisions which extend very deep on or even into the pearl seed, the spacing between the portion which holds the stone and the portion which guarantees the anchoring of the gemstone in the pearl is naturally reduced.

The use of the anchoring pin according to the invention is not limited to the manufacture of the pearl according to the invention but is also advantageous in the anchoring of mounts or stones in blind holes. The previously used anchoring means for stones in pearls do not have any local separation between the place at which the ornamental element itself is applied to the pearl and the place in which the ornamental element is anchored.

A possible embodiment of the anchoring pin according to the invention is shown in FIG. 28. The pin shown has along the longitudinal axis of the pin a cut which is smaller than the longitudinal axis of the pin. A portion of the pin is configured as a type of clasp in order to hold the ornamental element and/or stone mount, and after the pin has been inserted with the ornamental element and/or stone mount into the pearl incision, pressure is exerted on the anchoring depression. The subject matter of the invention is also the use of the above-described anchoring pin to anchor gemstones in pearls.

Naturally the ornamental element can also be anchored with other means known to the expert.

After the pearl incision has been cut, it can be enlarged and thus the pearl recessed more. Thus in a variant of the decorated natural or artificial pearl according to the invention, the original pearl seed can be partially or completely removed. In addition to the pearl incision originally applied, at least one window-like hole, a so-called "window opening" is applied. Into this window opening is inserted a pyramid- or cone-shaped inlay, the horizontal projection of which corresponds to that of the window aperture, in such a way that the thicker pyramid or cone base end points towards the pearl interior. Then the pearl seed is restored or a new pearl seed (in the place of the old one) inserted into the pearl. This new seed is preferably provided with a through-bore for the inner sleeve. The outer shape and dimensions of the renewed seed is preferably to be chosen in such a way that the pyramid or cone base of each inlay can rest thereon and the inlay fits securely self-locking in the relevant window opening.

The object of the invention is furthermore accomplished also with a further variant of the method for decorating pearls, which is characterized by the following measures:

first of all a pearl is provided with a through-bore and an outer sleeve is inserted into this through-bore which represents the functional counterpart of an inner sleeve, specifically in such a way that inner sleeve and outer sleeve can be positioned secure against twisting in relation to one another via means which are formed between inner sleeve outer wall and outer sleeve inner wall, i.e. can be pushed or guided into one another only in one orientation in respect of one another. Then the pearl is divided, perpendicular to the through-bore and the outer sleeve guided therein, into two or more spherical portions with an outer sleeve portion lying therein. Between respectively two originally adjacent spherical portions is positioned respectively at least one disc-shaped ornamental element which is provided perpendicular to its disc surface and preferably centrally with a through-bore, specifically in such a way that the through-bore of each disc-shaped ornamental element is flush with the through-bores or the outer sleeve portions of the spherical portions lying therein and forms a tubular channel. Then a or the inner sleeve, which represents the functional counterpart to the outer sleeve (portions) guided in the through-bores of the spherical portions, is introduced into this tubular channel, the individual spherical portions—as a result of the positioning of the inner sleeve in relation to the outer sleeve secure against twisting—assuming their original natural spatial orientation to one another again. In order to fix the spherical portions and the disc-shaped ornamental elements also secure against axial displacement, inner sleeve and outer sleeve are connected to one another. Here a method variant is preferred in which the inner sleeve is connected at its two free ends with the end faces of the outer sleeve (portions) ending on the pearl spherical surface (of the two calorie shells)—in the case of metal sleeves, for example, riveted.

A variant of this method which is particularly suitable for manufacturing a decorated pearl which has unmounted window- and belt-shaped inlays, is characterized in that in at least one of the spherical portions, the original pearl seed is completely or partially removed and thus a spherical half shell is formed. Then at least one window-like hole, a so-called "window opening" is incorporated in this spherical half shell. Into this window opening is inserted a pyramid- or cone-shaped inlay, the horizontal projection of which corresponds to that of the window opening, in such a way that the thicker pyramid or cone base end points towards the pearl interior. Then the pearl seed is restored or a new seed is inserted (in the place of the old one) into the spherical half shell(s) and provided with a through-bore for the inner sleeve. The outer shape and dimensions of the renewed seed is to be selected such that the pyramid or cone base of each inlay can be supported thereon and the inlay sits securely self-locking in the respective window opening.

Figure 2:
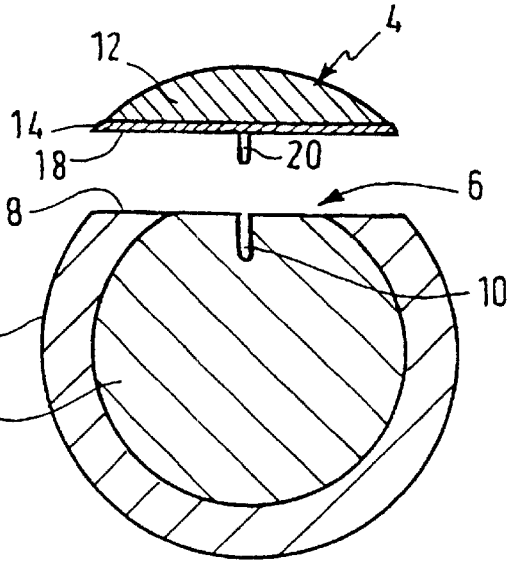
Figure 3:
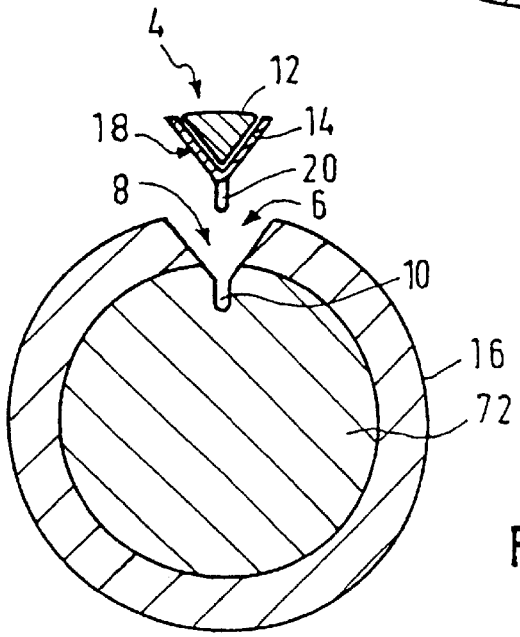
Figure 4:
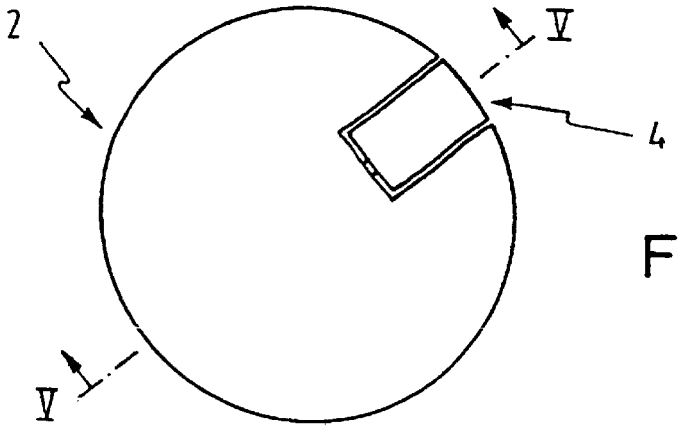
Figure 5:
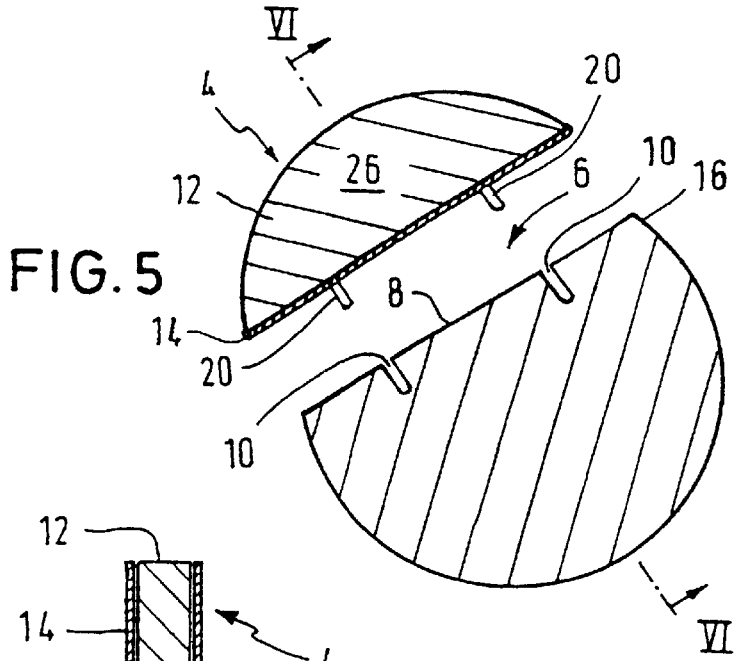
Figure 6:
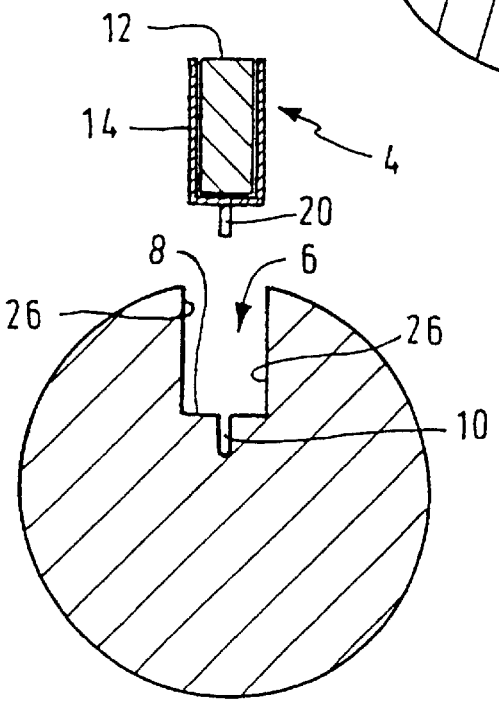
Figure 7:
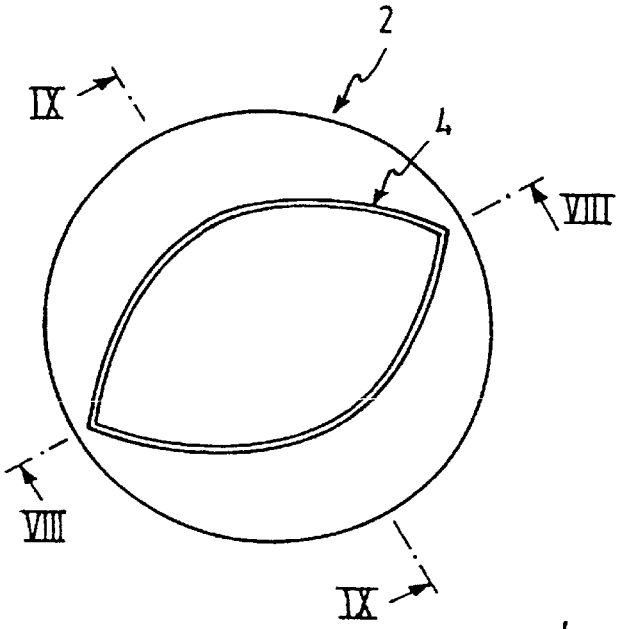
Figure 8:
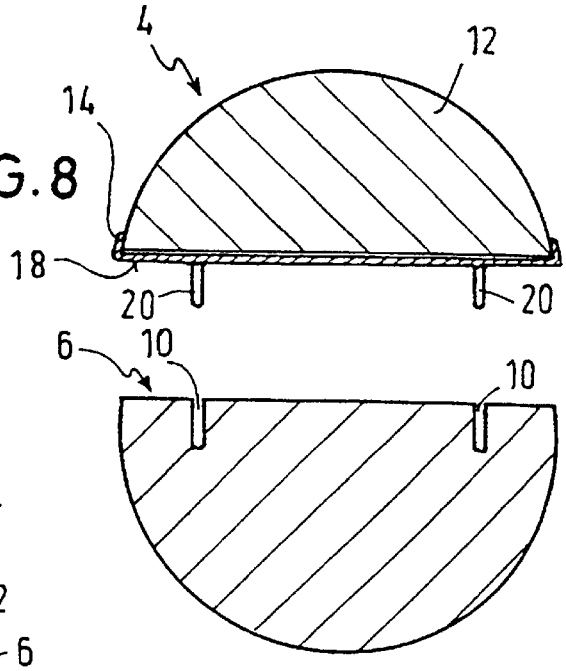
Figure 9:
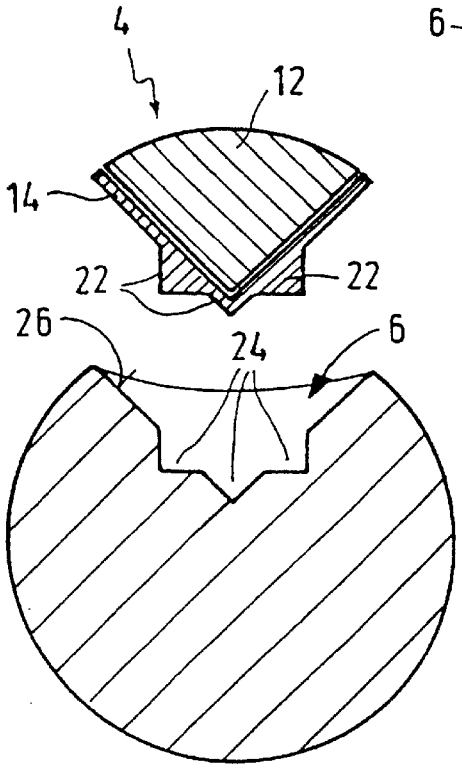
Figure 10:
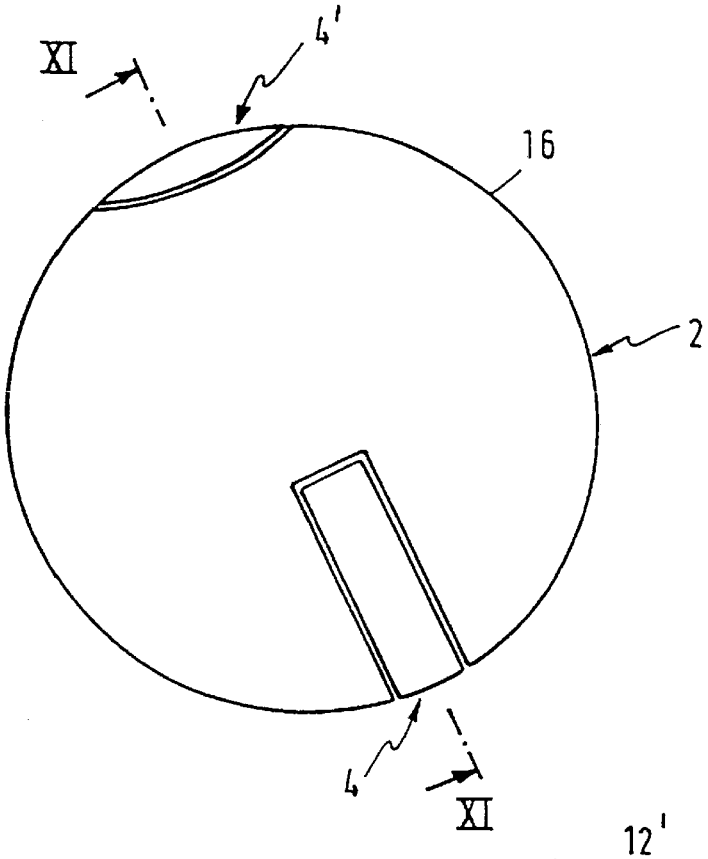
Figure 11:
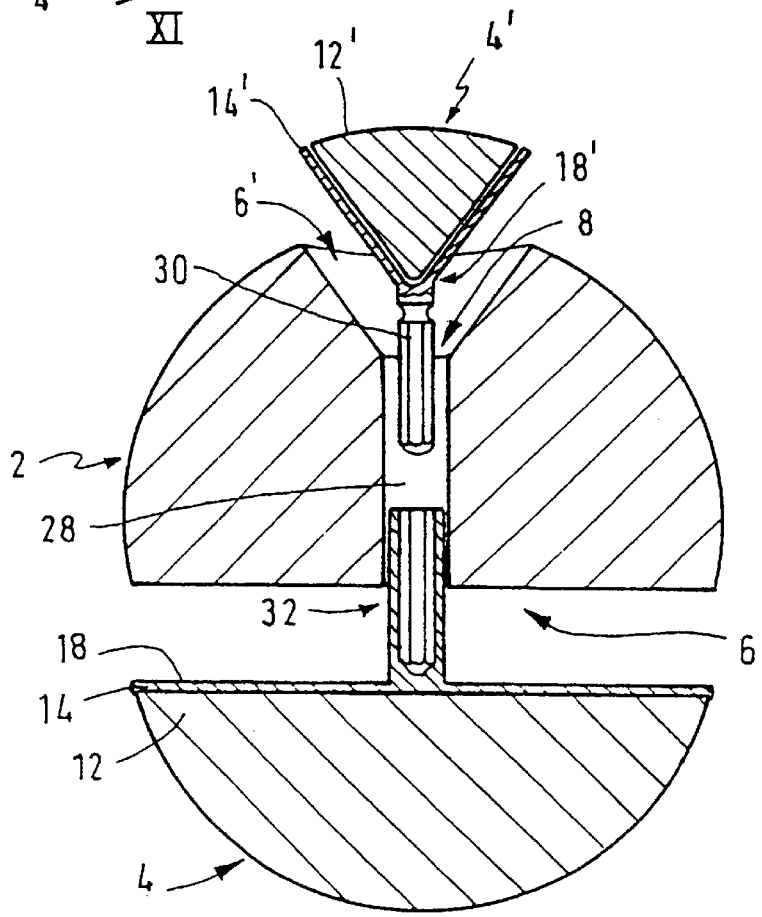
Figure 12:
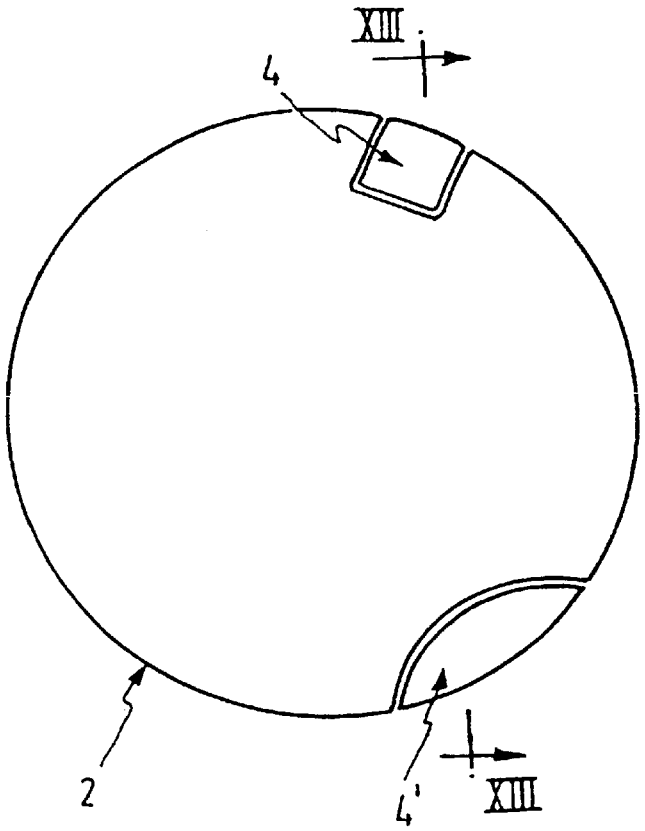
Figure 13:
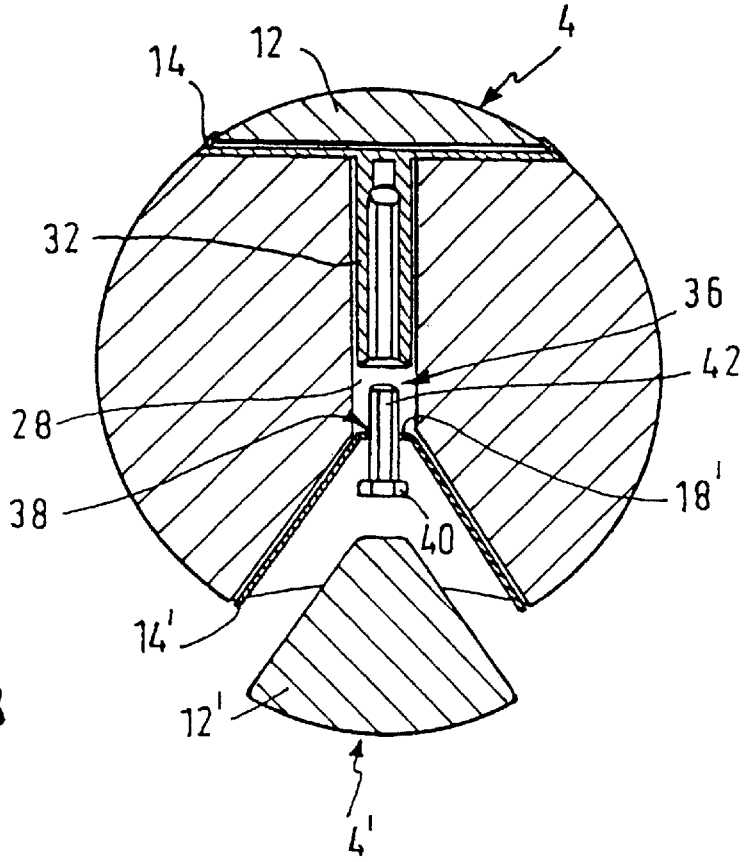
Figure 14:
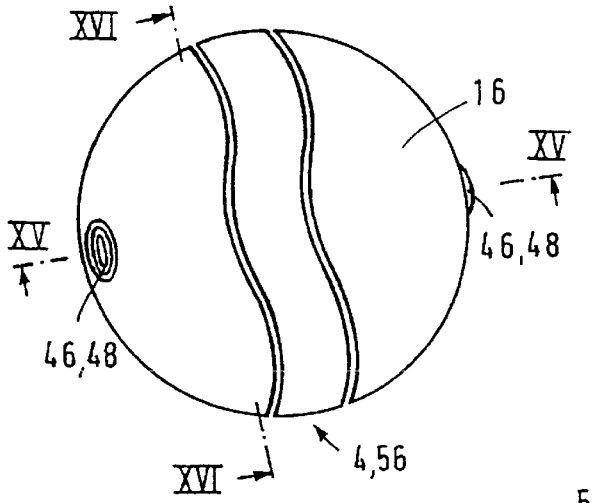
Figure 16:
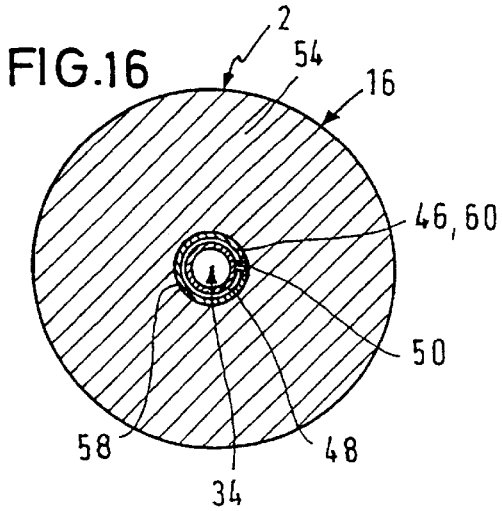
Figure 15:
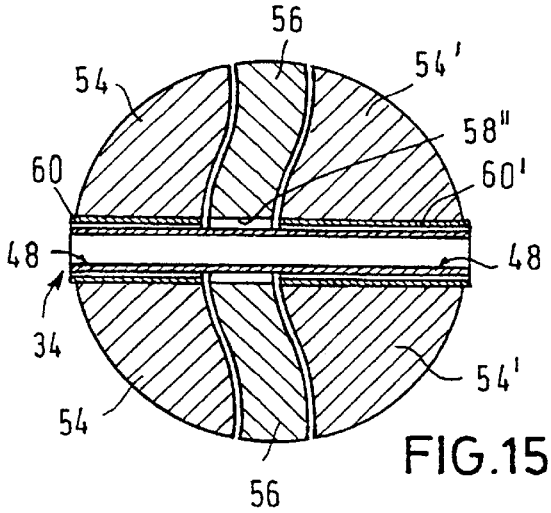
Figure 17:
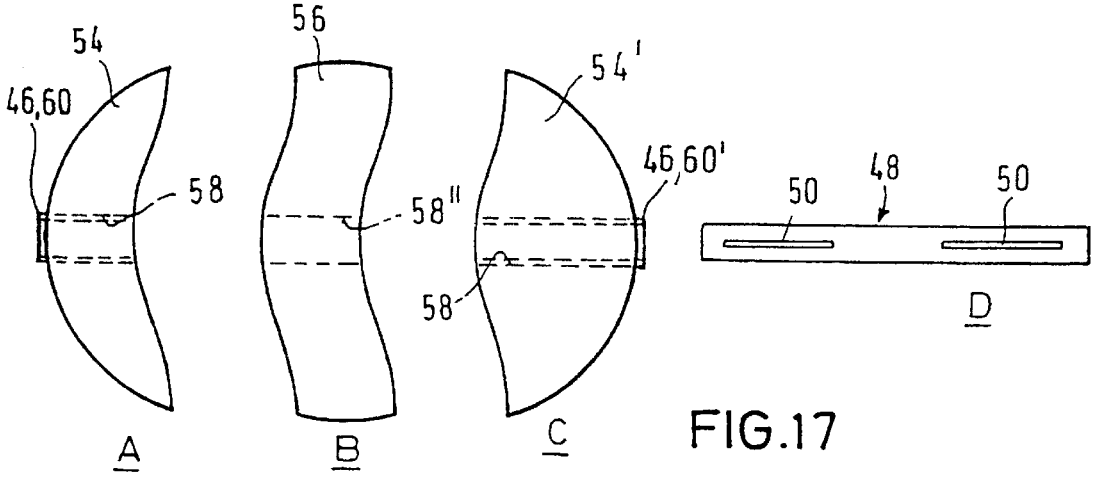
Figure 18:
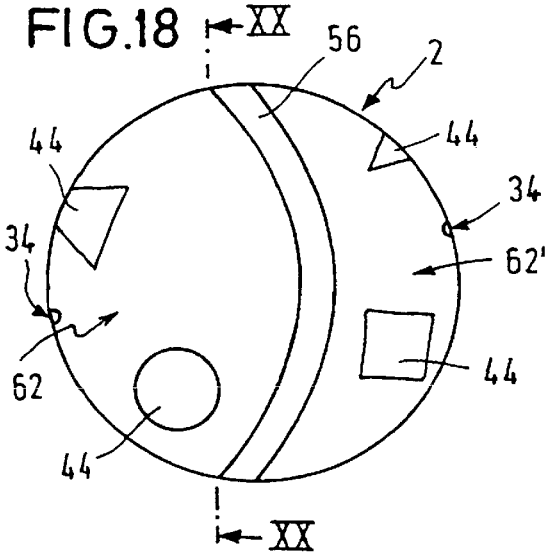
Figure 19:
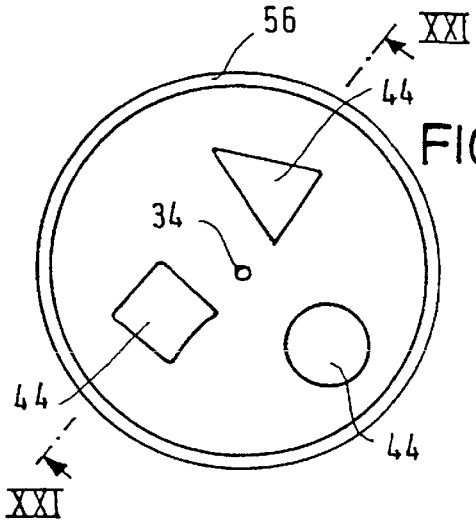
Figure 20:
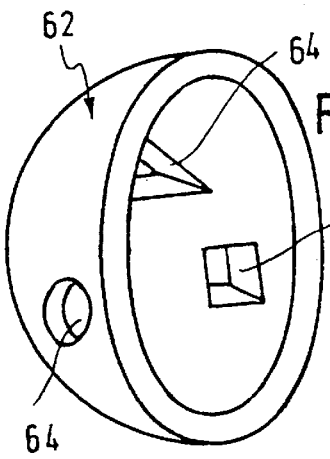
Figure 21:
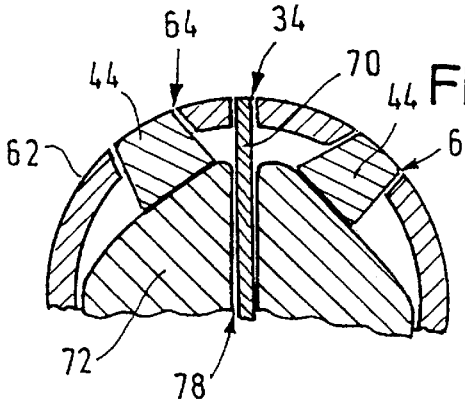
Figure 22:
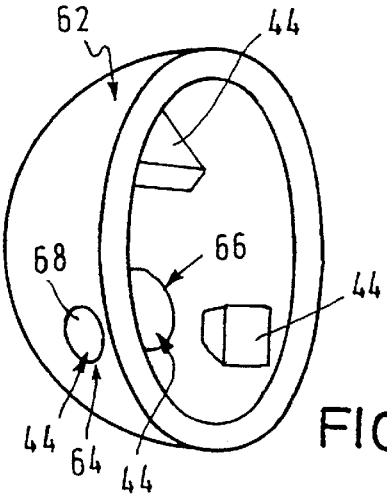
Figure 23:
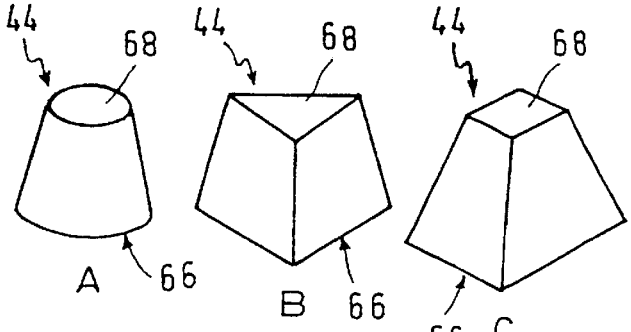
Figure 28A:
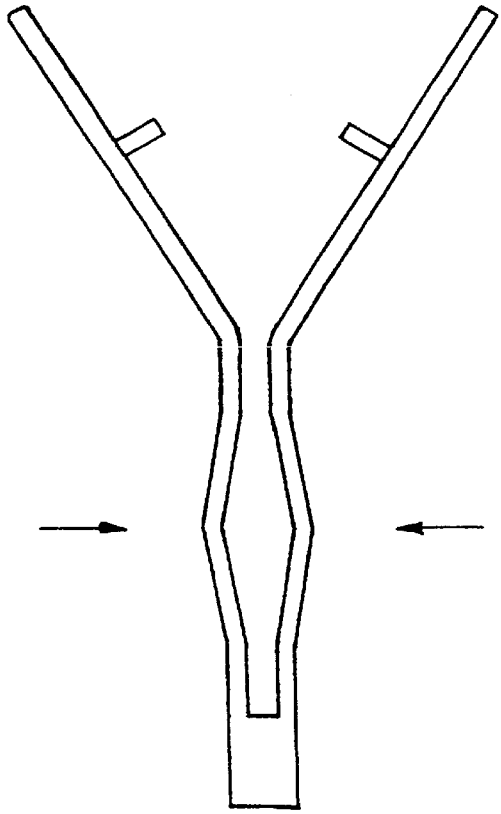
Figure 28B:
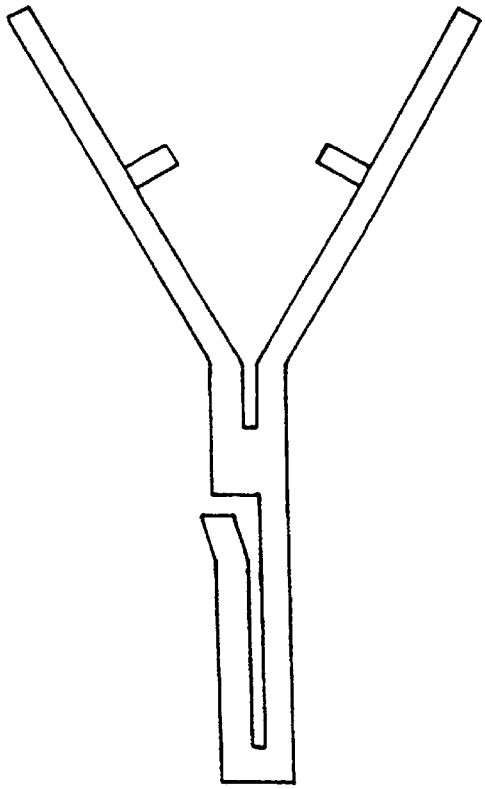
Figure 28C:
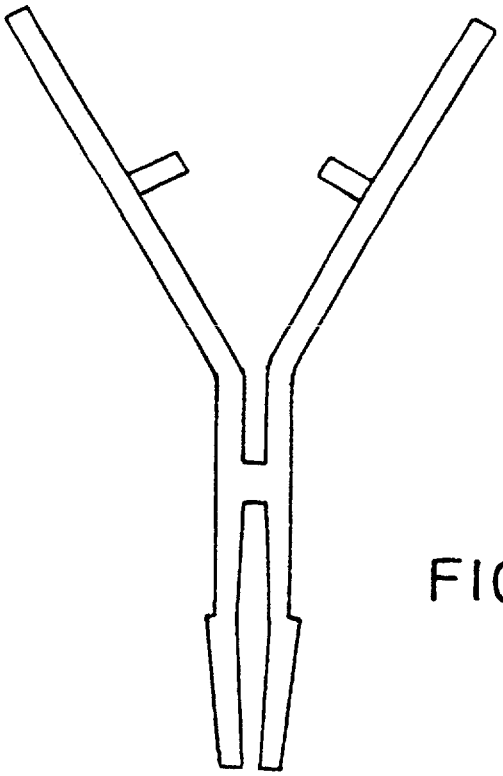
Figure 28D:
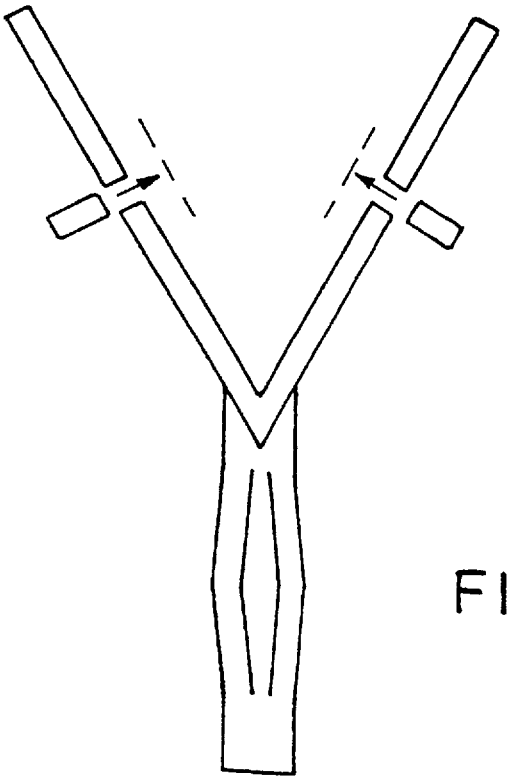

The invention is explained in greater detail below with the aid of embodiments shown in the drawings. These show:

FIG. 1 the perspective view of a pearl according co the invention having an elliptical cone-shaped inlay in a notch-shaped recess;

FIG. 2 the pearl according to FIG. 1 in section from II to II;

FIG. 3 the pearl according to FIG. 1 in section from III to III, with inlay drawn separately (drawn out);

FIG. 4 the perspective view of a pearl according to the invention having a semicircular disc-shaped inlay in a correspondingly shaped recess;

FIG. 5 the pearl according to FIG. 4 in a cross-section through the pearl centre from V to V, perpendicular to the plane of the diagram, inlay drawn separately;

FIG. 6 the pearl according to FIG. 4 in a cross-section through the pearl centre from VI to VI, in the plane of the diagram, inlay drawn separately;

FIG. 7 the perspective view of a pearl according to the invention with a large-area elliptical inlay in a wedge-shaped recess;

FIG. 8 the pearl according to FIG. 7 in section from VIII to VIII, inlay drawn separately;

FIG. 9 the pearl according to FIG. 7 in section from IX to IX, inlay drawn separately;

FIG. 10 the perspective view of a pearl according to the invention having two inlays which lie diametrically opposite one another and are connected to one another via connecting means in a passage running through the pearl centre between the two recesses;

FIG. 11 the pearl according to FIG. 10 in section, perpendicular to the plane of the drawing, from XI to XI, inlay drawn separately;

FIG. 12 the perspective view of a pearl according to the invention having two inlays which are connected to one another via connecting means in a passage running at a spacing from the pearl centre between the two recesses;

FIG. 13 the pearl according to FIG. 12 in section at a spacing from the centre from XIII to XIII, inlay drawn separately;

FIG. 14 the perspective view of a pearl according to he invention with a belt- or disc-shaped inlay;

FIG. 15 the pearl according to FIG. 14 in section from XV to XV;

FIG. 16 the pearl according to FIG. 14 in section from XVI to XVI;

FIG. 17 the individual components of the pearl according to FIG. 14, namely the two halves of the sphere (A) and (C), the inlay (B) and the inner sleeve (D);

FIG. 18 the perspective view of a pearl according to the invention having belt- or disc-shaped and windowpane-like inlays-without a mount;

FIG. 19 the same pearl as shown in FIG. 18, rotated by 90°;

FIG. 20 the half shell of the pearl according to FIG. 18, cut from XX to XX, perspective view, without inlays;

FIG. 21 the pearl according to FIG. 19 in section from XXI to XXI, partial view;

FIG. 22 the half shell according to FIG. 20 with inlays inserted;

FIG. 23 a cone-shaped inlay and two pyramid-shaped inlays to insert in a pearl according to FIGS. 18 to 22, FIG. 24 the perspective view of a pearl according to the invention having two cone-shaped inlays with a count and a plurality of windowpane-like inlays without mount;

FIG. 25 a section in the drawing plane through the pearl according to FIG. 24 before the incorporation of the window openings;

FIG. 26 a section in the drawing plane through the pearl according to FIG. 24 after incorporation of the window openings;

FIG. 27 a section in the drawing plane through the pearl according to FIG. 24; the inlay to be screwed in drawn separately, FIG. 28 anchoring pin.

In FIGS. 1 to 3 is represented a decorated natural or artificial pearl 2 according to the invention which has an inlay 4 with an elliptical ornamental surface or wedge- or ridge roof-shaped base. A notch-shaped recess 6 (or respectively depression) is incorporated in the pearl 2 for example cut, milled, filed or bored in. On the base 8 of recess 6, i.e. in this case in the longitudinal edge formed by the two oblique walls of the recess, is formed a hole 10, preferably bored. The inlay 4 consists of an ornamental element 12, especially a semi-precious or precious stone, in a metal mount 14, both the shape of the ornamental element 12 or stone—possibly through corresponding processing (grinding)—and that of the mount 14 being adapted to the notch shape of the recess 6 and to the curvature of the spherical pearl surface 16 of course the shape of the ornamental element or stone can also be varied, as long as it is accommodated in a mount which preferably fits as a form-fit into the recess 6 in the pearl 2. On the underside 18 of the mount 14, remote from the stone, is formed a pin 20 which can be inserted into the hole 10 in the base 8 of the recess 6, in order to connect (anchor or lock) inlay 4 and pearl 2 to one another). To stabilise this—preferably positive-locking—connection between the inlay 4 (ornamental element 12 or stone and mount 14) and the recess 6 incorporated in the pearl 2, the mount 14 can additionally be cemented or glued to the pearl 2.

FIGS. 4 to 6 show a pearl 2 according to the invention having an inlay 4 which has a band- or strip-shaped ornamental surface and a semicircular base. The recess 6, complementary thereto, in the base 2 has two approximately vertical walls 26 which are semicircular disc-shaped in outline and a base 8 which is band- or strip-shaped in outline running approximately horizontal thereto, the two narrow end faces of which end at the pearl surface 16. Otherwise this pearl 2 is constructed according to the same construction principle as the pearl 2 described in FIGS. 1 to 3 However, as locking or anchoring means two connecting pins 20 are formed on the inlay 4, and the recess 6 in the pearl 2 has correspondingly two (blind) holes 10 in congruent arrangement.

FIGS. 7 to 9 show a pearl 2 according to the invention having a wedge-shaped recess 6 and an inlay 4 provided for same which has a large-area, elliptical ornamental surface and a wedge-shaped base. The mount 14 of the inlay 4 is provided on its underside 18, facing the pearl 2, parallel to the longitudinal axis of the ellipse, with three wedge-shaped projections 22, which engage in the manner of feathers in correspondingly configured longitudinal grooves 24 in the base 8 and wall 26 of the recess 6. On the central lowermost projection 22 are formed two anchoring pins 20 which engage in corresponding blind holes 10 in the central lowermost groove 24. These pins 20 and complementary holes 10 can however also be dispensed with.

In FIG. 10 and FIG. 11 is represented a decorated natural or artificial pearl 2 according to the invention having two separate inlays 4, 4'. In the pearl surface 16 is incorporated a semicircular disc-shaped recess 6 (or depression), preferably milled in, which has approximately centrally a hole as a locking or anchoring means in its flat base 8. On the approximately diametrically opposite side of the pearl surface 16 is formed a second recess 6' (or depression), the contours of which here correspond to a cone and in the base of which 8' (the cone tip) a hole is also incorporated as a locking or anchoring means. The two recesses 6, 6' (depressions) and in particular the two holes are disposed orientated in respect of one another in such a way that they align with one another and form an almost rectilinear tubular passage 28 through the pearl centre. The two inlays 4, 4' for these recesses 6, 6' comprise respectively—as in FIGS. 1 to 6—an ornamental element 12, 12' more especially a semi-precious or precious stone in a metal mount 14, 14', both the shape of the ornamental element 12, 12' or stone—possibly by corresponding processing (grinding)—and that of the mount 14, 14' being adapted to the shape of the recess 6, 6' and to the curvature of the spherical pearl surface 16. In this example, too, the shape of the ornamental element 12, 12' can be varied as long as it is accommodated in a mount 14, 14' which fits preferably as a form-fit into the corresponding recess 6, or 6' in the pearl (surface) 2 or 16. Each inlay 4, 4' has on its underside 18, remote from the ornamental element 12, 12' or stone of the mount 14 a pin which can be inserted into the respective hole in the base of the respective recess. The pin of the one inlay 4—here the cone-shaped inlay—is a threaded pin 30, i.e. it is solid and provided with an external thread, and the pin of the other inlay 4' —here the semicircular disc-shaped inlay is formed as a threaded sleeve 32 i.e. as a sleeve with an internal thread. The threads of the two pins are complementary to one another and the length of each pin is of such dimensions that the pins can be introduced into one another and screwed to one another in the tubular passage 28 in order to connect inlays 4, 4' and pearl 2 to one another. To stabilise the connection between inlays 4, 4' and pearl 2, each inlay 4, 4' can also in this example be additionally cemented or glued to the base and/or walls of the relevant recess 6, 6' in the pearl 2.

In the manufacture of this pearl 2 the process is preferably such that first of all the inlay 4 (here semicircular disc-shaped) having the threaded sleeve 32 is inserted into the complementary recess 6 and then is the rotationally symmetric inlay 4 (here circular cone-shaped) provided with a threaded pin 30 is inserted by rotation into its recess 6' and simultaneously anchored in the threaded sleeve 32 of the opposite inlay 4.

When the non-rotationally symmetrical inlay with threaded pin is used, the embodiment according to FIGS. 12 to 13 is suggested. Here the relevant inlay 4' comprises three components, namely the ornamental element 12', more especially a semi-precious or precious stone, a mount 14' for same, and a threaded pin in the form of a screw 36. This screw 36 is guided in a hole 38 on the underside 18' of the mount 14', the screw head 40 lying against the underside surface pointing towards the ornamental element 12', and the screw pin 42 protruding at the underside surface, pointing towards the pearl 2, from said surface. With the screw 36 the mount 14 is fixed by twisting in the threaded sleeve 32 of the second inlay 4 and then the ornamental element 12' is inserted into the mount 14' and fixed therein in standard manner. FIGS. 14 to 17 show an embodiment of a pearl 2 according to the invention having a belt- or disc-shaped inlay 4. The pearl 2 is provided with a radial through-bore 58. Into this through-bore 58 is inserted a tube, comprising outer sleeve 46 (so-called "hinge") and inner sleeve 48 or inner pin (so-called "counter-hinge". The two sleeves 46, 48 (or respectively sleeve and pin) are oriented in respect of one another secure against twisting, with means 50 which act between the sleeves 46, 48, i.e. between the outer wall of the inner sleeve 48 (or of the inner pin) and the inner wall of the outer sleeve 46. The outer sleeve 46 is connected to the pearl 2, for example glued at its outer wall to the pearl wall and/or crimped on its two end faces to the pearl 2 or anchored in a similar manner. This pearl 2, provided with through-bore 58 and outer sleeve 46 located therein but remote inner sleeve 48 (or respectively inner pin), is divided, for example sawn, radially with respect to the longitudinal axis of the through-bore 58, into two spherical portions 54, 54'. Between these two separate spherical portions 54, 54' is disposed a disc-shaped ornamental element 56, preferably a precious or semi-precious stone disc, the disc surface of which is substantially congruent with the basal surfaces of the spherical portions 54, 54', and which is or are provided centrally with a through-bore 58", the diameter of which is congruent or practically congruent with that of the outer sleeve (portions) 46 or 60, 60' in the two spherical portions 54, 54'.

The two spherical portions 54, 54' (sphere halves) and the ornamental element disc 56 disposed between same are disposed radially secure against twisting by the inner sleeve 48 (or inner pin) inserted into the outer sleeve (portions) 46 or respectively 60, 60' and the through-bore 58" in the stone disc 56. For axial fixing, the inner sleeve 48 (or inner pin) is fixed to the two end faces of the outer sleeve 46 ending at the spherical surface 16 or both spherical caps or calottes. Inner sleeve 48 (or inner pin) and outer sleeve 46 preferably consist of metal and the axial fixing is preferably realized by riveting.

In a simpler variant—not shown here in greater detail of this embodiment, the tube consists only of a sleeve (a "hinge") by means of which the spherical portions and stone disc(s) are riveted.

In FIGS. 18–23 is represented a pearl 2 according to the invention having a belt- or disc-shaped inlay and a plurality of windowpane-like inlays 44, which are all integrated without any mount into the pearl surface. The pearl 2 comprises two halves or hemispheres which have been produced by sawing or similar dividing methods. The pearl seed 72 (i.e. the foreign body which originally got into the oyster either in a natural manner or through the hand of the cultivator and has triggered the formation of the pearl) is removed totally or partially from each pearl half, for example, milled out, sawn out or the like, by which means in each case a (pearl or spherical) half shell 62, 62' has been produced. In each of these two pearl half shells 62, 62' are formed—for example—three window-like holes, so-called "window openings" 64, respectively one in the shape of a triangle, one in the shape of a rectangle and one in the shape of a circle. Basically, however, the window openings 64 can also be of any other shape. In each of these window openings 64 is disposed a windowpane-like inlay 44 in the form of an unmounted ornamental element in a cone, wedge or pyramid shape, more especially a semi-precious or precious stone.

What is essential to the invention is that each of these inlays 44 is at least approximately cone-, wedge- or pyramid-shaped i.e. two end faces have different basal surfaces, namely a larger so-called base side 66 and a so-called tip side 68, smaller than the former, which are disposed in relation to one another in such a way that their respective mid-point lies on a common imaginary axis and the basal surface of the base side 66 protrudes beyond that of the tip side 68 along their entire perimeter line or at least the predominant portion of same (cf. FIG. 23).

In the embodiment shown here, the inlays 44 for the triangular and rectangular window openings 64 respectively have the shape of a truncated pyramid (as per FIG. 23, B, C) with correspondingly triangular or rectangular basal surface, and the inlays for the round window openings 64 have in each case the shape of a truncated cone (according to FIG. 23 A). These truncated pyramids and cones are disposed in the window openings 64 in such a manner that the pyramid or cone base 66 points towards the pearl interior or respectively the half shell opening and the tip 68 of the (in this example) truncated cone or pyramid points away from the pearl interior or respectively the half shell opening and lies flush in or at the pearl spherical surface 16 (cf. FIG. 22). The tip 68 of the truncated cone or pyramid can—as in the embodiment shown here by way of example—be adapted to the curvature of the pearl spherical surface 16 in order to obtain an at least almost ideal homogenous (uniformly smooth and closed) spherical surface 16. However, it can also protrude beyond the pearl (spherical) surface 16 or be sunk into same. Basically it is true that the tip 68 of the cone or pyramid can also be present or respectively can be preserved and furthermore—if desired—can be shaped (moulded) in addition.

The pearl half shells 62 or 62' provided with window openings 64 and wedge-, cone-, or pyramid-shaped inlays 44 inserted in same are combined into a closed pearl sphere 2, a disc-shaped ornamental element 56, preferably of semi-precious or precious stone, being disposed at the boundary surface between the two half shells 62 and 62' or sphere halves. This disc-shaped ornamental element 56 has the same basal surface as each of the two sphere halves or pearl half shells 62, 62'. Half shells 62, 62' and ornamental disc 56 placed between same are in each case provided centrally with a through-bore 34 in which a rod-shaped support element 70 is arranged (cf. FIG. 21). The support element 70 is securely connected at one end to the one pearl half shell 62 and at the other end to the other pearl half shell 62', such that the two half shells 62, 62' and the ornamental disc 56 disposed between same are fixed to one another secure against displacement or twisting. As the rod-shaped support element 70, in particular a metal pin can be considered which is crimped at both ends to the pearl surface 16 or securely connected in some other manner. In the pearl interior, i.e. in the cavity formed by the half shells 62, 62', is disposed a new pearl seed 72—formed for example from plastics material, stone or other materials—or respectively the old seed is correspondingly restored again. The inlays 44 are supported with their respective cone or pyramid base 66 against this seed (cf. FIG. 21.) As a result of this support and because of the amount by which their base 66 exceeds the relevant window opening 64, they sit in said opening self-locking and secure against slipping. The support element 70 is guided through a bore 78 in the pearl seed 72 (cf. FIG. 21).

FIGS. 24–27 show yet another variant of a decorated pearl 2 according to the invention which can be understood as a combination or synthesis of the pearls according to FIGS. 10-14 and the pearl according to FIGS. 18–23. In this pearl 2, two recesses 6, 6' are incorporated in the pearl surface 16 and are connected to one another by a tubular through-bore 28. The one recess 6' is formed as a flat pit in the shape of a truncated cone, the truncated cone pointing towards the pearl interior and thus forming the base of the recess 6', whilst the cone base represents the opening of recess 6' at the pearl surface 16. In this recess 6' is disposed an inlay 4' comprising mount 14' and mounted ornamental element 12' which has on its underside 18', facing the base of the recess, a pin-shaped threaded sleeve 32 which lies in the through-bore 28. The second recess 6 opens out into a cavity 74 or is formed as a cavity 74, which extends below the pearl surface 16 tangentially and radially into the pearl interior. In recess 6 itself sits a pointed cone-shaped inlay 4 which is screwed via a threaded pin on its underside, i.e. the point of the cone, in the through-bore 28 to the threaded sleeve 32 of the opposite inlay 4'. In the cavity walls 76, pointing away from the pearl interior, are formed window-like hole apertures, so-called window openings 64, in which unmounted ornamental elements sit as a form-fit as windowpane-like inlays 44. These ornamental elements or windowpane-like inlays 44 have the basic shape of a pyramid or truncated cone and are orientated in the window openings 64 in such a way that the base of the pyramid or truncated cone points towards the pearl interior, whilst the pyramid or truncated cone surface terminates flush with the pearl surface 16. By jamming and/or supporting one another and/or being supported on the cavity walls 76 and/or on the inlay(s) 4,4' sitting in the recess/the two recesses 6, 6', the position of these ornamental elements 44 in the window openings 64 is fixed.

What is claimed is:

1. A decorated natural or artificial pearl comprising a spherical surface, a center, at least one recess and at least one integrated ornamental element having a surface and an underside facing the pearl, wherein the ornamental element is substantially a form-fit in the recess of the pearl appropriately made for the ornamental element and wherein the recess has at least a base and a wall and is not a blind hole, and wherein the underside of each ornamental element is provided with at least one anchoring means formed in the base and/or the wall of the recess which co-operates with the anchoring means and secures the ornamental element sitting in the recess to the pearl, wherein the ornamental element is configured as an inlay with any contour and dimensions substantially within the limits of the spherical surface of the pearl, the surface of the ornamental element being substantially flush with the curvature of the spherical surface of the pearl.

2. The decorated natural or artificial pearl according to claim 1, wherein the ornamental element is a semi-precious or precious stone.

3. The decorated natural or artificial pearl according to claim 1, wherein the ornamental element is configured as an inlay with a mount.

4. The decorated natural or artificial pearl according to claim 1, wherein the pearl further has outer spherical layers, and wherein the recess is not as deep as it is long and wide, and lies in the outer spherical layers of the pearl.

5. The decorated natural or artificial pearl according to claim 1, wherein the recess is formed in the shape of a wedge, cone or tetrahedron having a tip, with the tip of the wedge, cone or tetrahedron pointing towards the center of the pearl.

6. The decorated natural or artificial pearl according to claim 1, wherein the anchoring means comprises a projection formed on the underside of the ornamental element and a depression on the base and/or wall of the recess in the pearl, with said projection being complementary to the depression of said base and/or wall.

7. The decorated natural or artificial pearl according to claim 1, wherein the pearl surface has at least two recesses each having respectively at least one tubular hole on the base of the recess as an anchoring means, which recesses are disposed spatially in relation to one another in such a manner that the at least one tubular hole on the base of one recess forms with the at least one tubular hole on the base of the other recess a tubular passage, wherein the pearl surface has at least two ornamental elements sitting in the at least two recesses as inlays, wherein each of the at least two ornamental elements further comprising a connecting means, and wherein the at least two ornamental elements are connected to one another at their connecting means sitting in the tubular passage.

8. A method of manufacturing a decorated natural or artificial pearl according to claim 1, which comprises the following steps:

a) cutting into the pearl to provide an incision having a base and a wall in the pearl, b) producing a depression on the base or wall of the incision, c) fitting the ornamental element having an anchoring means attached into the incision, d) anchoring the anchoring means to the depression in order to secure the ornamental element in the incision, and e) making the surface of the ornamental element substantially flush with a curvature of the spherical surface of the pearl to integrate the surface of the ornamental element into the surface of the pearl.

9. The method according to claim 8, wherein the pearl is first cut into and then the depression is applied to the base or the wall of the pearl incision.

10. The method according to claim 8, wherein the depression is produced by a bore.

11. The method according to claim 8, wherein step e) is achieved by grinding.

12. The method according to claim 8, wherein the incision is made at an angle of between 60° and 90°.

13. The method according to claim 8, wherein the incision is made having a tip pointing towards a center of the pearl.

14. The method according to claim 8, wherein in step c) the ornamental element having the anchoring means attached is fitted into the incision by attaching the anchoring means to a stone mount and fitting the stone mount into the incision.

15. The method according to claim 14, wherein locking bores are applied to the stone mount and the ornamental element to accommodate a portion of the anchoring means, the locking bores in the ornamental element and in the stone mount matching one another exactly, and wherein another portion of the anchoring means is anchored in the depression or bore of the incision.

16. The method according to claim 8, wherein the anchoring means is an anchoring pin.

17. The method according to claim 8, wherein the stone mount and the ornamental element have locking holes, wherein the anchoring pin grips through the locking holes of the stone mount into the locking holes of the ornamental element like a clasp.

18. The method according to claim 17, wherein the anchoring pin when inserted exerts pressure on the bore which serves to anchor the ornamental element and the stone mount in the incision.

19. A method of manufacturing a decorated natural or artificial pearl according to claim 1, which comprises the following steps:

a) cutting into the pearl to provide an incision having a base and a wall in the pearl, b) producing a depression or bore on the base or wall of the incision, c) fitting a stone mount into the incision, d) attaching an anchoring means to the stone mount and to the ornamental element, e) anchoring the anchoring means to the depression or bore to fit the ornamental element to the stone mount in order to secure the ornamental element in the incision, and f) making the surface of the ornamental element substantially flush with a curvature of the spherical surface of the pearl to integrate the surface of the ornamental element into the surface of the pearl.

20. The method according to claim 19, wherein locking bores are applied to the stone mount and the ornamental element to accommodate a portion of the anchoring means, the locking bores in the ornamental element and in the stone mount matching one another exactly, and wherein another portion of the anchoring means is anchored in the depression or bore of the incision.

21. The method according to claim 19, wherein the according means is an anchoring pin.

22. An anchoring pin to another gemstones in pearl incisions according to claim 1, wherein the pin is formed either by means of a resilient mechanism as a clip, stopper or locking device in order to hold the ornamental element and/or stone mount, and the pin is possibly soldered securely to the stone mount, and wherein after the pin has been inserted with ornamental element and/or stone mount into the pearl incision, pressure is exerted on the anchoring depression by the resilient mechanism.

23. The anchoring pin according to claim 22, wherein the gemstone is anchored by a different portion of the pin from the portion anchoring the gemstone in the pearl.

24. A method of anchoring a gemstone in pearls, comprising attaching the gemstone to the anchoring pin according to claim 22.

25. A decorated natural or artificial pearl comprising a surface, at least one recess and at least one integrated ornamental element having a surface and an underside facing the pearl, wherein the ornamental element is substantially a form-fit in the recess of the pearl appropriately made for the ornamental element and wherein the recess has at least a base and a wall, and wherein the underside of each ornamental element is provided with at least one anchoring means formed in the base and/or the wall of the recess which co-operates with the anchoring means and secures the ornamental element sitting in the recess to the pearl, wherein the ornamental element is configured as an inlay with any contour and dimensions substantially within the limits of the surface of the pearl, the surface of the ornamental element being substantially flush with the surface of the pearl.

26. The decorated natural or artificial pearl according to claim 25, wherein the ornamental element is a semi-precious or precious stone.

27. The decorated natural or artificial pearl according to claim 25, wherein the ornamental element is configured as an inlay with a mount.

28. The decorated natural or artificial pearl according to claim 25, wherein the pearl further has outer layers, and wherein the recess is not as deep as it is long and wide, and lies in the outer layers of the pearl.

29. The decorated natural or a artificial pearl according to claim 25, said pearl further comprising a center, wherein the recess is formed in the shape of a wedge, cone or tetrahedron having a tip, with the tip of the wedge, cone or tetrahedron pointing towards the center of the pearl.

30. The decorated natural or artificial pearl according to claim 25, wherein the anchoring means comprises a projection formed on the underside of the ornamental element and a depression on the base and/or wall of the recess in the pearl, with said projection being complementary to the depression of said base and/or wall.

31. The decorated natural or artificial pearl according to claim 25, wherein the pearl surface has at least two recesses each having respectively at least one tubular hole on the base of the recess as an anchoring means, which recesses are disposed spatially in relation to one another in such a manner that the at least one tubular hole on the base of one recess forms with the at least one tubular hole on the base of the other recess a tubular passage, wherein the pearl surface has at least two ornamental elements sitting in the at least two recesses as inlays, wherein each of the at least two ornamental elements further comprising a connecting means, and wherein the at least two ornamental elements are connected to one another at their connecting means sitting in the tubular passage.

32. A method of manufacturing a decorated natural or artificial pearl according to claim 25, which comprises the following steps:

a) cutting into the pearl to provide an incision having a base and a wall in the pearl, b) producing a depression on the base or wall of the incision, c) fitting the ornamental element having an anchoring means attached into the incision, d) anchoring the anchoring means to the depression in order to secure the ornamental element in the incision, and e) making the surface of the ornamental element substantially flush with a surface of the pearl.

33. The method according to claim 32, wherein the pearl is first cut into and then the depression is applied to the base or the wall of the pearl incision.

34. The method according to claim 32, wherein the depression is produced by a bore.

35. The method according to claim 32, wherein step e) is achieved by grinding.

36. The method according to claim 32, wherein the incision is made at an angle of between 60° and 90°.

37. The method according to claim 32, said pearl further comprises a center, wherein the incision is made having a tip pointing towards the center of the pearl.

38. The method according to claim 32, wherein in step c) the ornamental element having the anchoring means attached is fitted into the incision by attaching the anchoring means to a stone mount and fitting the stone mount into the incision.

39. The method according to claim 38, wherein locking bores are applied to the stone mount and the ornamental element to accommodate a portion of the anchoring means, the locking bores in the ornamental element and in the stone mount matching one another exactly, and wherein another portion of the anchoring means is anchored in the depression or bore of the incision.

40. The method according to claim 32, wherein the anchoring means is an anchoring pin.

41. The method according to claim 32, wherein the stone mount and the ornamental element have locking holes, wherein the anchoring pin grips through the locking holes of the stone mount into the locking holes of the ornamental element like a clasp.

42. The method according to claim 41, wherein the anchoring pin when inserted exerts pressure on the bore which serves to anchor the ornamental element and the stone mount in the incision.

43. A method of manufacturing a decorated natural or artificial pearl according to claim 25, which comprises the following steps:

a) cutting into the pearl to provide an incision having a base and a wall in the pearl, b) producing a depression or bore on the base or wall of the incision, c) fitting a stone mount into the incision, d) attaching an anchoring means to the stone mount and to the ornamental element, e) anchoring the anchoring means to the depression or bore to fit the ornamental element to the stone mount in order to secure the ornamental element in the incision, and f) making the surface of the ornamental element substantially flush with a surface of the pearl.

44. The method according to claim 43, wherein locking bores are applied to the stone mount and the ornamental element to accommodate a portion of the anchoring means, the locking bores in the ornamental element and in the stone mount matching one another exactly, and wherein another portion of the anchoring means is anchored in the depression or bore of the incision.

45. The method according to claim 43, wherein the anchoring means is an anchoring pin.

46. An anchoring pin to anchor gemstones in pearl incisions according to claim 25, wherein the pin is formed either by means of a resilient mechanism as a clip, stopper or locking device in order to hold the ornamental element and/or stone mount, and the pin is possibly soldered securely to the stone mount, and wherein after the pin has been inserted with ornamental element and/or stone mount into the pearl incision, pressure is exerted on the anchoring depression by the resilient mechanism.

47. The anchoring pin according to claim 46, wherein the gemstone is anchored by a different portion of the pin from the portion anchoring the gemstone in the pearl.

48. A method of anchoring a gemstone in pearls, comprising attaching the gemstone to the anchoring pin according to claim 46.

* * * * *